US011577883B2

(12) United States Patent
Ripplinger et al.

(10) Patent No.: US 11,577,883 B2
(45) Date of Patent: Feb. 14, 2023

(54) LATCH FOR A SLEEVE PACK ASSEMBLY

(71) Applicant: ORBIS Corporation, Oconomowoc, WI (US)

(72) Inventors: Gina L. Ripplinger, Ixonia, WI (US); Benjamin J. Thompson, Watertown, WI (US); Alexander Ryan Wiklin, Waukesha, WI (US)

(73) Assignee: ORBIS Corporation, Oconomowoc, WI (US)

( * ) Notice: Subject to any disclaimer, the term of this patent is extended or adjusted under 35 U.S.C. 154(b) by 166 days.

(21) Appl. No.: 16/839,742

(22) Filed: Apr. 3, 2020

(65) Prior Publication Data

US 2020/0317399 A1 Oct. 8, 2020

Related U.S. Application Data

(60) Provisional application No. 62/873,419, filed on Jul. 12, 2019, provisional application No. 62/829,967, filed on Apr. 5, 2019.

(51) Int. Cl.
*B65D 19/06* (2006.01)

(52) U.S. Cl.
CPC .... *B65D 19/06* (2013.01); *B65D 2519/00497* (2013.01); *B65D 2519/00661* (2013.01)

(58) Field of Classification Search
CPC ..... B65D 19/06; B65D 19/385; B65D 19/18; B65D 19/38; B65D 2519/00497; B65D 2519/00661; B65D 21/086; B65D 11/1893
USPC ..... 206/386
See application file for complete search history.

(56) References Cited

U.S. PATENT DOCUMENTS

| | | | | |
|---|---|---|---|---|
| 3,374,915 | A | 3/1968 | Verhein et al. | |
| 3,650,459 | A | 3/1972 | Tucker | |
| 3,797,691 | A | 3/1974 | Williams, Jr. | |
| 3,926,412 | A | 12/1975 | Beretta | |
| 3,966,072 | A | 6/1976 | Gonzales et al. | |
| 4,030,600 | A | 6/1977 | Heaps | |
| 4,209,183 | A | 6/1980 | Jones et al. | |
| 4,221,296 | A | 9/1980 | Fell et al. | |
| 4,453,471 | A * | 6/1984 | Harrington | B65D 9/24 217/65 |
| 4,591,065 | A | 5/1986 | Foy | |
| 4,626,155 | A | 12/1986 | Hlinsky et al. | |
| 4,720,013 | A | 1/1988 | Nichols et al. | |
| 4,746,053 | A | 5/1988 | Nichols | |
| 4,765,252 | A | 8/1988 | Shuert | |
| 4,798,290 | A | 1/1989 | Bradford | |

(Continued)

FOREIGN PATENT DOCUMENTS

| | | |
|---|---|---|
| CA | 3000185 A1 | 10/2018 |
| DE | 69820095 T2 | 7/2004 |

(Continued)

OTHER PUBLICATIONS

European Patent Office, Examination Report for European Application No. 14150885.3, dated Nov. 9, 2015, 4 pages.

(Continued)

*Primary Examiner* — Robert Poon
(74) *Attorney, Agent, or Firm* — Greensfelder, Hemker & Gale, P.C.; Richard C. Himelhoch

(57) ABSTRACT

The invention is directed to a latch for a sleeve pack assembly.

10 Claims, 14 Drawing Sheets

(56) References Cited

U.S. PATENT DOCUMENTS

| | | | | |
|---|---|---|---|---|
| 4,936,451 | A * | 6/1990 | Shuert | B65D 19/06 206/386 |
| 4,966,280 | A | 10/1990 | Bradford | |
| 5,017,260 | A | 5/1991 | Bradford | |
| 5,037,027 | A | 8/1991 | Nichols | |
| 5,050,793 | A * | 9/1991 | Graham, Jr. | B65D 19/16 52/582.2 |
| 5,109,985 | A * | 5/1992 | Rose | B65D 19/06 206/600 |
| 5,123,541 | A | 6/1992 | Giannini et al. | |
| 5,161,709 | A | 11/1992 | Oestreich, Jr. | |
| 5,295,632 | A | 3/1994 | Zink et al. | |
| 5,462,221 | A | 10/1995 | Zink et al. | |
| 5,522,539 | A | 6/1996 | Bazany | |
| 5,538,178 | A | 7/1996 | Zink et al. | |
| 5,597,084 | A * | 1/1997 | Parasin | B65D 19/18 220/4.28 |
| 5,597,113 | A | 1/1997 | Bradford | |
| 5,638,983 | A | 6/1997 | Bazany | |
| 5,722,328 | A | 3/1998 | Darby | |
| 5,725,118 | A | 3/1998 | Slager et al. | |
| 5,725,119 | A | 3/1998 | Bradford et al. | |
| 5,732,876 | A | 3/1998 | Bradford | |
| 5,788,146 | A | 8/1998 | Bradford et al. | |
| 5,813,566 | A | 9/1998 | Bradford et al. | |
| 5,862,917 | A * | 1/1999 | Noble | B65D 19/18 206/600 |
| 5,908,135 | A | 6/1999 | Bradford et al. | |
| 6,024,223 | A | 2/2000 | Ritter | |
| 6,305,601 | B1 | 10/2001 | Bazany et al. | |
| 6,305,726 | B1 | 10/2001 | LeTrudet | |
| 6,349,877 | B1 | 2/2002 | Bradford | |
| D454,692 | S | 3/2002 | Bublitz | |
| D455,266 | S | 4/2002 | Bradford | |
| 6,460,724 | B1 | 10/2002 | Bradford | |
| 6,540,096 | B1 | 4/2003 | Bazany et al. | |
| 6,547,127 | B2 | 4/2003 | Bradford et al. | |
| 6,564,993 | B1 | 5/2003 | Wassink | |
| 6,592,025 | B2 | 7/2003 | Bazany et al. | |
| 6,619,540 | B1 | 9/2003 | Bazany | |
| 6,669,242 | B2 | 12/2003 | Fountaine et al. | |
| 6,899,242 | B2 | 5/2005 | Overholt et al. | |
| 6,902,061 | B1 | 6/2005 | Elstone | |
| 7,017,766 | B2 | 3/2006 | Hsu et al. | |
| 7,083,369 | B2 | 8/2006 | Nyeboer | |
| 7,258,232 | B2 | 8/2007 | Bradford et al. | |
| 7,322,485 | B2 | 1/2008 | Bradford et al. | |
| 7,344,043 | B2 | 3/2008 | Nyeboer | |
| 7,344,044 | B2 | 3/2008 | Bradford et al. | |
| 7,360,663 | B2 | 4/2008 | Vroon | |
| 7,380,358 | B2 | 6/2008 | Bazany et al. | |
| 7,410,094 | B2 | 8/2008 | Bos | |
| 7,428,975 | B2 | 9/2008 | Bradford | |
| 7,503,462 | B2 | 3/2009 | Vroon | |
| 7,540,390 | B2 | 6/2009 | Bublitz et al. | |
| 7,552,826 | B2 * | 6/2009 | Watanabe | B65D 19/02 24/457 |
| 7,556,170 | B2 | 7/2009 | Vroon | |
| 7,644,830 | B2 | 1/2010 | Vroon | |
| 7,644,831 | B2 | 1/2010 | Vroon | |
| 7,654,408 | B2 | 2/2010 | Bazany | |
| 7,694,836 | B2 | 4/2010 | Overholt et al. | |
| 7,748,559 | B2 | 7/2010 | Bradford | |
| 7,748,803 | B2 | 7/2010 | Bazany et al. | |
| 7,762,422 | B2 | 7/2010 | Dobrinski | |
| 7,774,919 | B2 | 8/2010 | Bublitz | |
| 7,775,419 | B2 | 8/2010 | Bale | |
| 7,878,345 | B2 | 2/2011 | Tourlamain | |
| 7,878,362 | B2 | 2/2011 | Nyeboer | |
| 8,061,549 | B2 | 11/2011 | Nyeboer et al. | |
| 8,079,490 | B2 | 12/2011 | Nyeboer et al. | |
| 8,100,282 | B2 | 1/2012 | Nyeboer et al. | |
| 8,100,283 | B2 | 1/2012 | Nyeboer et al. | |
| 8,109,402 | B2 | 2/2012 | Hartwall | |
| 8,112,859 | B2 | 2/2012 | Vroon | |
| 8,146,224 | B1 | 4/2012 | Vroon | |
| 8,523,004 | B2 | 9/2013 | Vroon | |
| 8,608,003 | B2 | 12/2013 | Uno | |
| 8,910,790 | B2 | 12/2014 | Trickett | |
| 8,955,709 | B2 | 2/2015 | Lorenz et al. | |
| 8,966,732 | B2 | 3/2015 | Vroon | |
| 8,973,236 | B2 | 3/2015 | Vroon | |
| 9,126,371 | B2 | 9/2015 | Vroon | |
| 9,227,364 | B2 | 1/2016 | Vroon | |
| 9,487,329 | B2 | 11/2016 | Balazs et al. | |
| 9,663,291 | B1 | 5/2017 | Sanger | |
| 9,718,236 | B2 | 8/2017 | Vroon | |
| 9,764,876 | B2 | 9/2017 | Balazs et al. | |
| 2004/0060835 | A1 | 4/2004 | Gits | |
| 2005/0199623 | A1 | 9/2005 | Elder et al. | |
| 2007/0221718 | A1 | 9/2007 | Nyeboer | |
| 2007/0221719 | A1 | 9/2007 | Vroon et al. | |
| 2007/0221720 | A1 | 9/2007 | Nyeboer | |
| 2007/0221721 | A1 * | 9/2007 | Bradford | B65D 21/0213 229/199 |
| 2009/0032432 | A1 | 2/2009 | Kostos et al. | |
| 2009/0314675 | A1 | 12/2009 | Stahl | |
| 2010/0242249 | A1 | 9/2010 | Vroon | |
| 2012/0073109 | A1 | 3/2012 | Vroon | |
| 2013/0154216 | A1 | 6/2013 | Paulk, Sr. et al. | |
| 2014/0096351 | A1 | 4/2014 | Vroon | |
| 2014/0209600 | A1 * | 7/2014 | Schloesser | B65D 9/12 220/4.33 |
| 2014/0284247 | A1 * | 9/2014 | Balazs | B65D 19/06 206/600 |
| 2015/0108037 | A1 | 4/2015 | Evans et al. | |
| 2016/0075082 | A1 | 3/2016 | Vroon | |
| 2016/0194110 | A1 | 7/2016 | Balazs et al. | |
| 2017/0029004 | A1 | 2/2017 | Della Polla | |
| 2017/0029166 | A1 | 2/2017 | Balazs et al. | |
| 2017/0137213 | A1 | 5/2017 | Sanger | |
| 2017/0282444 | A1 | 10/2017 | Vroon | |
| 2018/0127148 | A1 | 5/2018 | Kuhn et al. | |
| 2018/0186508 | A1 | 7/2018 | Carman | |
| 2019/0055057 | A1 | 2/2019 | Wood et al. | |
| 2021/0009177 | A1 | 1/2021 | Buss et al. | |

FOREIGN PATENT DOCUMENTS

| | | | |
|---|---|---|---|
| DE | 102005031526 | A1 | 4/2007 |
| DE | 102017000274 | A1 | 7/2018 |
| EP | 1120326 | A1 | 8/2001 |
| EP | 2256051 | A1 | 12/2010 |
| EP | 2368683 | A2 | 9/2011 |
| EP | 2441554 | A1 | 4/2012 |
| EP | 2783996 | A1 | 10/2014 |
| EP | 2783996 | B1 | 4/2017 |
| FR | 2126521 | | 6/1972 |
| GB | 2440327 | A | 1/2008 |
| JP | 2008308194 | A | 12/2008 |
| JP | 2009107703 | A | 5/2009 |
| WO | 2006132613 | A1 | 12/2006 |
| WO | 2007112376 | A2 | 10/2007 |
| WO | 2008011237 | A2 | 1/2008 |
| WO | 2019022683 | A1 | 1/2019 |
| WO | 2020148212 | A1 | 7/2020 |

OTHER PUBLICATIONS

European Patent Office, Extended European Search Report for European Application No. 14150885.3, dated Jul. 3, 2014, 7 pages.

* cited by examiner

LATCH FOR A SLEEVE PACK ASSEMBLY

CROSS-REFERENCE TO RELATED APPLICATIONS

The present application claims priority to and the benefit of U.S. Provisional Patent Application No. 62/873,419 filed Jul. 12, 2019, and U.S. Provisional Patent Application No. 62/829,967 filed Apr. 5, 2019, the contents of which are incorporated herein by reference and made a part hereof.

FEDERALLY SPONSORED RESEARCH OR DEVELOPMENT

N/A

FIELD OF THE INVENTION

Description of the Prior Art

Returnable bulk containers come in two general classifications, sleeve packs and knock downs. A sleeve pack includes a pallet, a sleeve and a top cap. To assemble and disassemble a sleeve pack, there are two options to retain (i.e., lock) the bottom portion of the sleeve to the pallet and the top portion of the sleeve to the top cap. These include: (1) a passive interference fit, and (2) an active latching mechanism.

The passive interference fit lock generally creates a weak engagement with the sleeve, can be difficult to assemble, and can damage the sleeve. Many of the active latching mechanisms require the operator to bend over or kneel and reach under the pallet to engage and disengage the lock.

The present invention provides the desirable aspects of both designs, allowing for an easy passive latch assembly without the need to bend and reach, while providing a strong "lock" between the components.

Additional aspects of the present invention are set forth herein.

SUMMARY OF THE INVENTION

Disclosed herein is a sleeve pack assembly having a plurality of connected walls defining a polygonal shaped sleeve, a polygonal shaped frame, and a latch engaging the sleeve. The sleeve has an opening at each of two opposed ends, and an aperture extends through one of the plurality of walls proximate one of the two opposed ends. The polygonal shaped frame has a channel for receiving one of the two opposed ends of the sleeve and the aperture. The latch has a segmented body with a first portion, a second portion, a third portion, a fourth portion, and a fifth portion. The body has a first generally C-shaped member facing a first direction and a second generally C-shaped member facing a second direction opposed to the first direction. The first portion has a snap extending beyond a planar surface of the first portion and is positioned in the aperture. The fifth portion has a tongue extending beyond a planar surface of the fifth portion and engages the polygonal shaped frame.

Also, disclosed herein is a sleeve pack assembly having a plurality of connected walls defining a polygonal shaped sleeve, a polygonal shaped frame, and a latch engaging the sleeve. The sleeve has an opening at each of two opposed ends, and an aperture extends through one of the plurality of walls proximate one of the two opposed ends. The aperture is framed by a plurality of connected edges. The polygonal shaped frame has a channel for receiving one of the two opposed ends of the sleeve and the aperture. The latch has a U-shaped body disposed in the aperture and has a first leg and a second leg. An arm extends from the first leg and terminates in an axle. The axle is pivotally connected to the frame proximate the channel. The second leg engages one of the plurality of connected edges.

Other features and advantages of the invention will be apparent from the following specification taken in conjunction with the following Figures and Attachments.

BRIEF DESCRIPTION OF THE DRAWINGS

To understand the present invention, it will now be described by way of example, with reference to the accompanying drawings in which.

DETAILED DESCRIPTION

Figure 1:
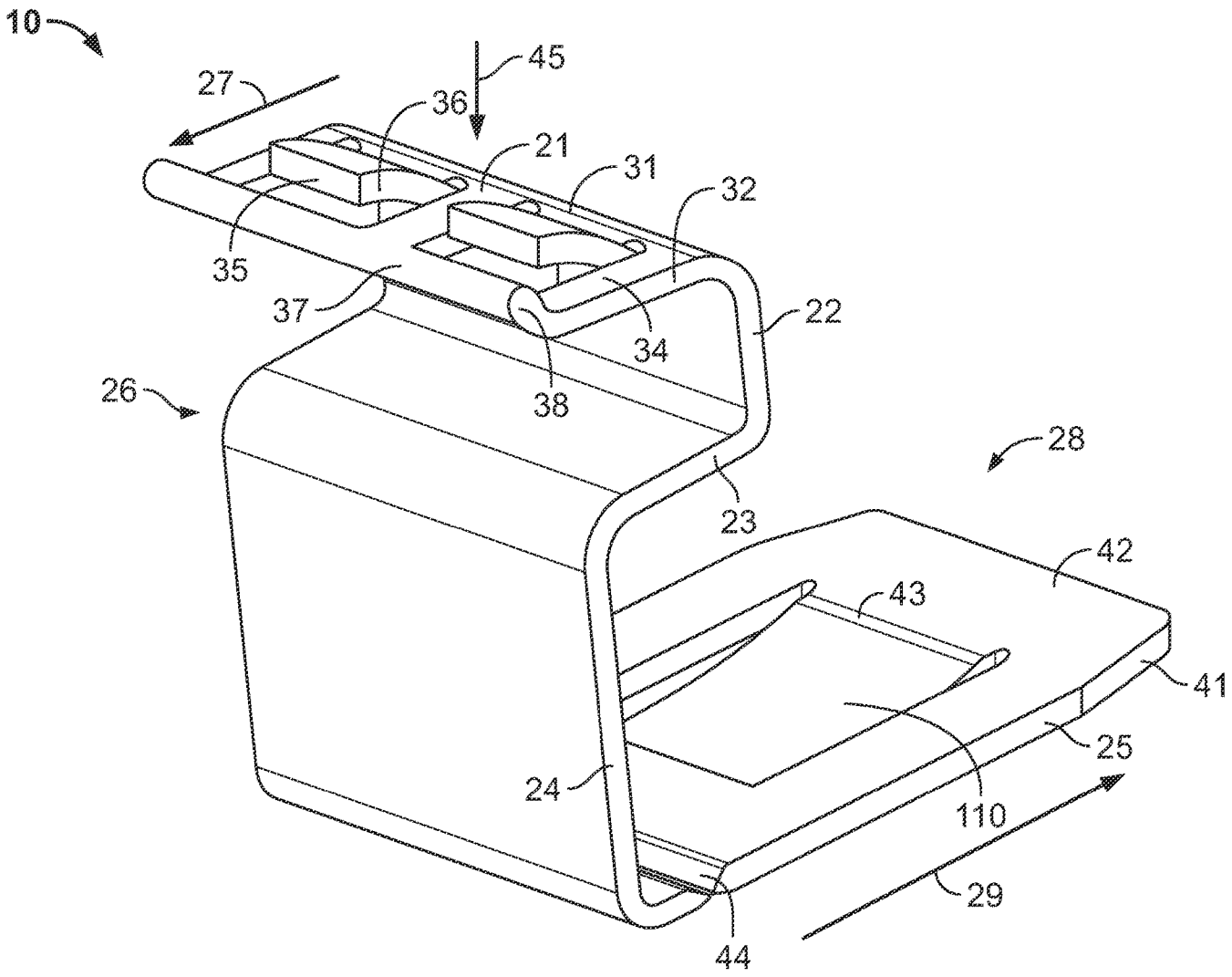
FIG. 1 is a perspective view of a latch.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
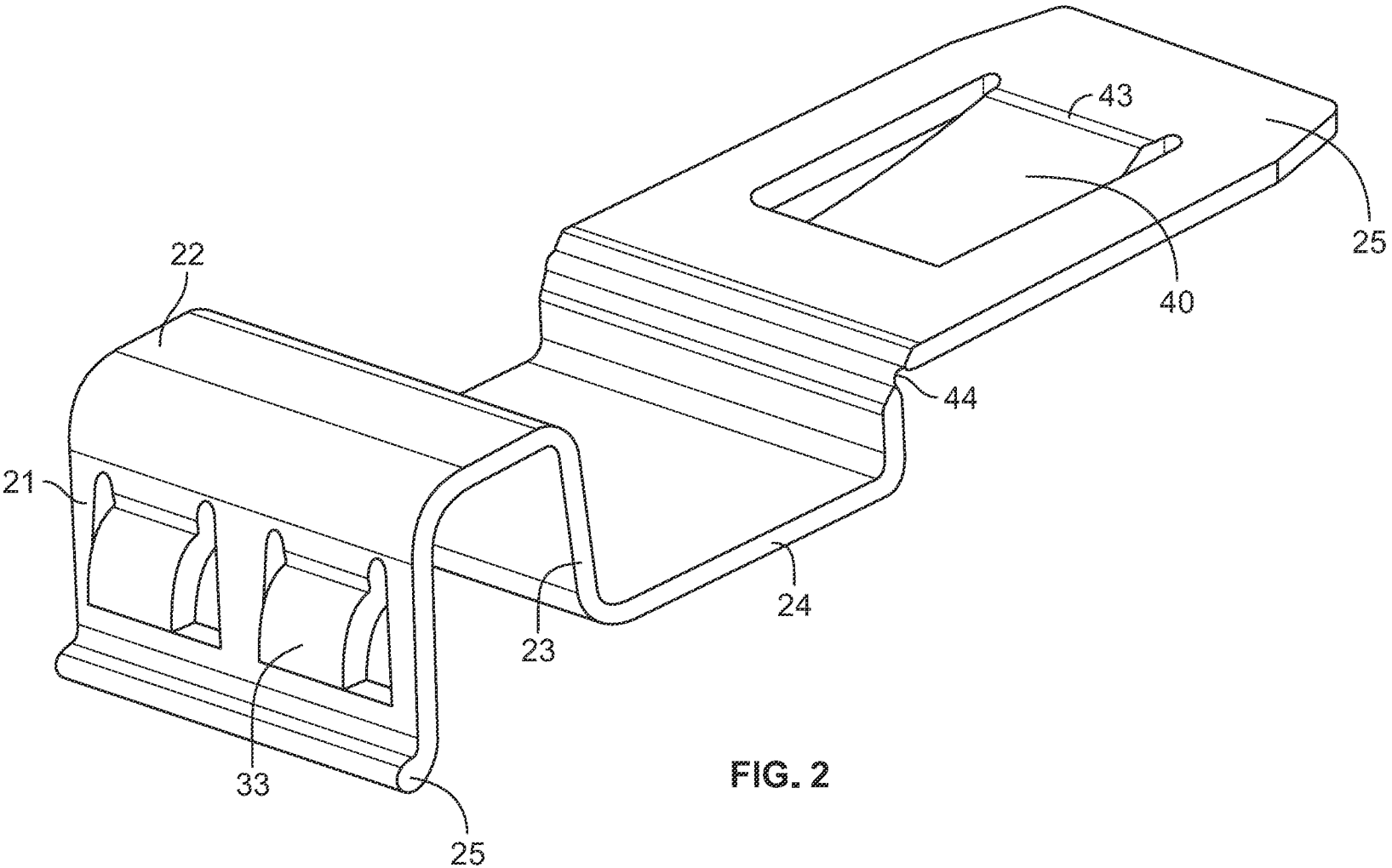
FIG. 2 is perspective view of the latch of FIG. 1 is a disengaged position.

FIGS. 1-4 show a latch 10 for connecting a sleeve 12 to a frame 14 to form a sleeve pack assembly 16. The latch 10 has a segmented body having a first portion 21, a second portion 22, a third portion 23, a fourth portion 24, and a fifth portion 25 connected together in sequence. FIG. 1 shows the latch 10 in an engaged position and FIG. 2 shows the latch 10 in a disengaged position. When in the engaged position, the first portion 21, the second portion 22, and the third portion 23 form a first C-shaped member 26 facing a first direction 27. Also, the third portion 23, the fourth portion 24, and the fifth portion 25 form a second C-shaped member 28 facing a second direction 29 opposed to the first direction 27.

The first C-shaped member 26 is connected to the second C-shaped member 28 and share in common the third portion 23.

The first portion 21 has an upper planar surface 31 and a lower planar surface 32. Two snaps 33, spaced from one another, are deformed from the material constituting the first portion to form an angle 34 with the upper planar surface 31. The angle 34 can vary from three degrees to 45°. Since the snaps are deformed from the material, there is an opening 35 where the snap used to be. The snaps 33 are generally rectangular in shape and are connected by a hinge 36 to the first portion 21. The first portion 21 terminates in an enlarged distal end with an upturned flange or lip 37. The flange 37 is above the upper planar surface 31 and is connected thereto along an upwardly sloping surface 38. While two snaps 33 are shown, it is contemplated using only a single snap 33 or two or more snaps. Additionally, the snaps 33 are shown disposed above the upper planar surface, but they could also be disposed in the opposite direction below the lower planar surface. Additionally, it is contemplated that one snap could extend above the upper planar surface while another of the snaps extends below the lower planar surface.

The fifth portion 25 has a tongue 40 deformed from the material of the fifth portion 25 and extends below a lower planar surface 41 of the fifth portion 25. Since the tongue 40 is deformed through the fifth portion a slot 42 is formed over an opening through the fifth portion. The tongue 40 is connected to the fifth portion 25 along a hinge 43. It is contemplated that the tongue 40 could extend above an upper planar surface 42 of the fifth portion 25 as well. A living hinge 44 extends between and connects opposed lateral edges of the fifth panel. It is preferred to space the living hinge inward of the fourth panel 24. The tongue 40 is generally rectangular in shape.

The latch 10 forms a spring that biases the first portion into engagement with an aperture of the sleeve by a latching force. As shown in FIG. 1, this would be upward or vertically upward. By pressing downward along arrow 45, the latching force is overcome and the first portion deflects downwardly out of engagement with the aperture to a disengaged position. When in this position, the sleeve can be removed from the frame.

Suitable materials for forming the latch include plastics, metals, and composite materials. Suitable plastics include homopolymers and copolymers of polyolefins, polyurethanes, polyamides, acrylonitrile butadiene styrene (ABS), polyesters, polystyrenes, to name a few. More preferably the plastic will be a homopolymer of copolymer of polypropylene, a homopolymer or copolymer of polyethylene including high density polyethylene (HDPE), low density polyethylene (LDPE), linear low density polyethylene (LLDPE) and ultra-low density polyethylene (ULDPE). The latch is fabricated by injection molding.

Suitable metals to fabricate the latch 10 include steel, aluminum, magnesium, iron, and alloys of metals.

Figure 3:
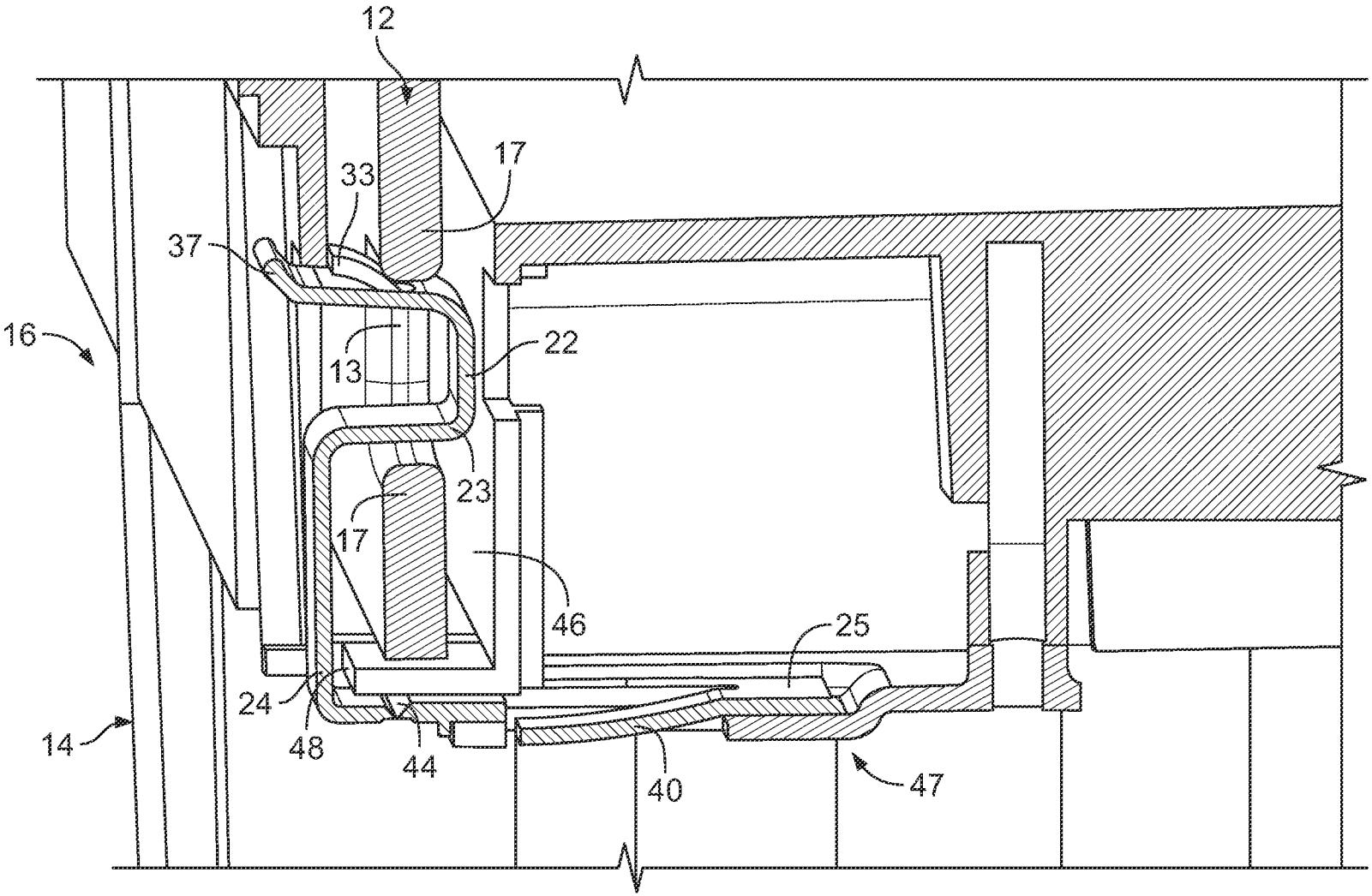
FIG. 3 is a perspective view in cross-section of the latch shown in FIG. 1 disposed in an aperture of a sleeve and connected to a frame.
Figure 4:
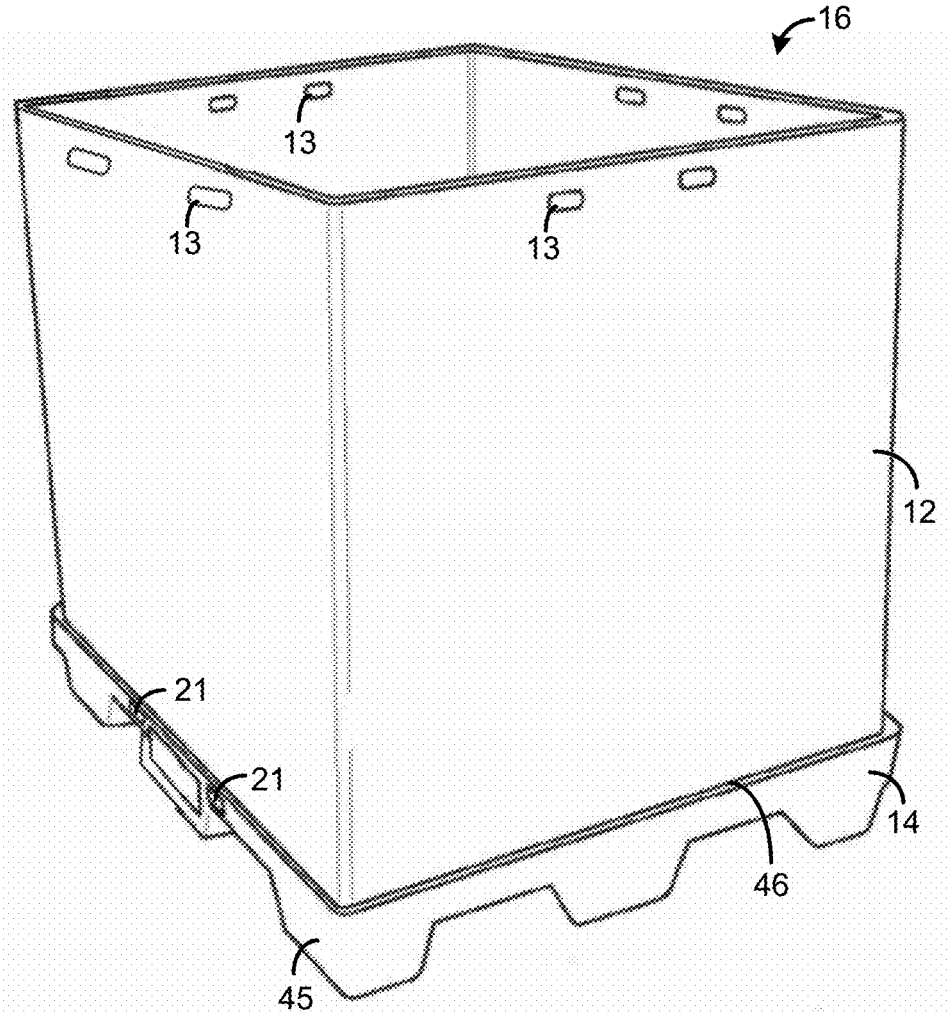
FIG. 4 is a perspective view of the sleeve pack assembly.

The sleeve 12 as shown in FIGS. 3 and 4, is typically folded from a blank of material into a polygonal shaped body having from three to nine panels, for example, with openings at opposed ends of the sleeve. An aperture 13 extends through the thickness of the material to form a through hole of sufficient dimension to receive a portion of the latch 10. The sleeve shown in FIG. 4 has two apertures 13 spaced from one another at a top end and a bottom end of the panel. The latches on the bottom end are positioned in a channel 46 of the pallet 14 as shown in FIG. 3. By providing apertures 13 on all panels and at both ends, the sleeve can be mounted to the frame in any orientation.

The aperture 13 can be used in any number from one single aperture 13 to two to 24 apertures, for example. The apertures can be of various shapes including circular, oval, and polygonal. The apertures 13 are framed by a continuous edge of material 17 or a series of connected edges 17. One or more of these edges 17 are engaged by a portion of the latch 10 when in an engaged position. If the aperture 13 is square or rectangular it will have four connected edges 17 framing the aperture 13. If the aperture 13 is circular or oval it will have a single continuous edge. Suitable polygonal shapes include those having from three to nine sides i.e., triangle, square, rectangular, pentagonal, hexagonal, heptagonal, and nonagonal. The polygons can be regular polygons with all sides and angles of equal dimension or degree, or irregular polygons where all sides and angles are not equal in dimension or degree. The apertures shown are generally rectangular in shape.

Suitable materials for forming the sleeve include corrugated paperboard, paperboard, plastic sheeting, plastic corrugated, and trilaminate. Typically, the sleeve can be folded down upon itself to form a collapsed position for shipping and storage. When in a deployed position, the polygonal sleeve is disposed vertically to define a chamber and uses the frame 14 as a bottom wall. Thus, the contents of the chamber are accessible through the upper opening. One suitable sleeve is shown in commonly owned U.S. Pat. No. 9,487,329 which is incorporated in its entirety herein by reference and made a part hereof.

The frame 14 has a peripheral wall, polygonal in shape, and supports a planar surface. The planar surface can be of a continuous material or can be a surface formed by a matrix of intersecting walls. The planar surface serves as a bottom wall of the sleeve 12 when the sleeve is mounted thereto. The peripheral wall has a vertically disposed planar surface 45 that forms a front wall of a channel 46 that extends along a portion of the peripheral wall. The channel 46 is dimensioned to receive a bottom edge of the sleeve and the aperture 13.

The frame 14 has an attachment area 47 positioned below the frame planar surface for receiving the fifth portion 25 of the latch. The tongue 40 engages a slat of the pallet 14 and is supported by a surface of the pallet. The frame has two openings through the vertical surface 45 to accommodate the latch 12. The first opening 48 is connected by a slot 49 to the attachment area 47. When the latch is in the engaged position of FIG. 3, the fifth portion 25 is positioned in the slot 49. As shown in FIG. 3, the fourth portion 24 extends vertically in a plane parallel to an outer planar surface of the sleeve, and then the third portion extends 90° right and through a second opening in the vertical surface 45 that is in alignment with the aperture 13, through the aperture, then into the channel 46. The third portion can abut the edge 17 or be in close proximity thereto. The second portion 22 extends vertically inside the channel 46 in a plane parallel to an inner planar surface of the sleeve but spaced inwardly therefrom. The first portion 21 takes a left turn 90° back through the aperture 13 and into engagement with the edge 17. The snaps extend outward beyond the sleeve and abut an outer planar surface of the sleeve above the edge 17. The spring action of the latch disposes is vertically upwardly to press the first portion into engagement with the sleeve to hold the sleeve in place in the channel.

The enlarged distal end of the first portion 21 extends outward of the sleeve and the pallet vertical surface 45 through the second opening. The flange 37 can be readily accessed by an operator of the assembly who can press downwardly to overcome the spring force of the latch and pull rearwardly to rotate the latch about the living hinge 44 downwardly into a disengaged position where the latch takes on more of a horizontal form as shown in FIG. 2 and extends outwardly from the vertical surface 45 at roughly 90° or perpendicular thereto. The engagement and disengagement process can occur repeatedly.

The frame 14 can include structures such as pallets and top caps as are well known in the industry and are described in commonly owned U.S. Pat. No. 9,487,329 mentioned above.

Figure 5:
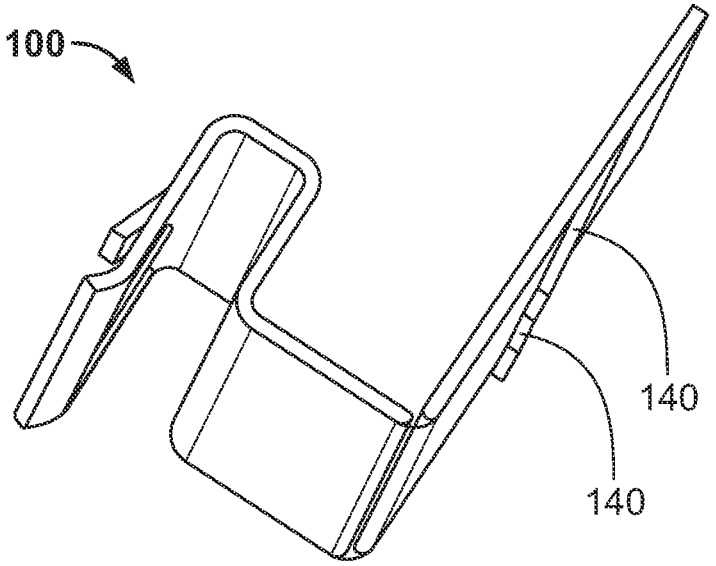
FIG. 5 is a perspective view of an alternative latch.
Figure 6:
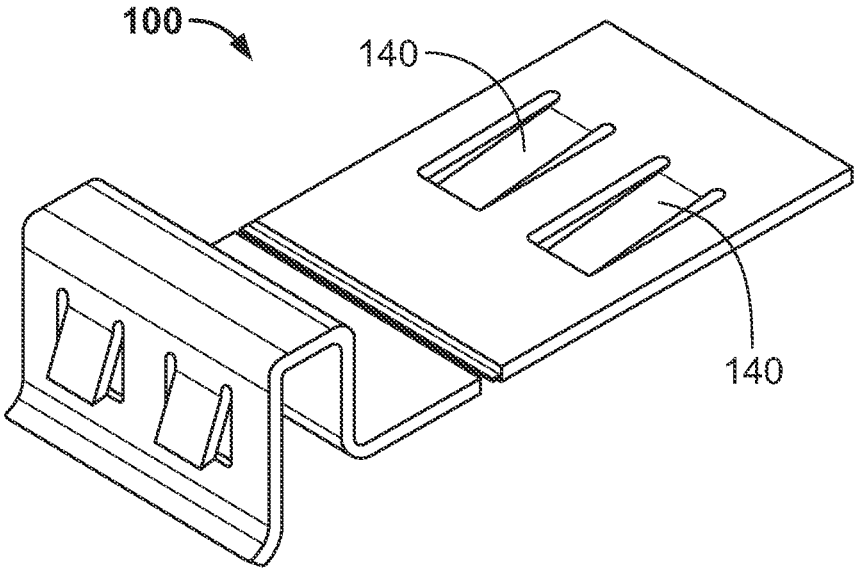
FIG. 6 is a perspective view of the alternative latch of FIG. 4 in a disengaged position.

FIGS. 5 and 6 show an alternative latch 100 respectively in an engaged position and a disengaged position. This latch differs from the latch of FIGS. 1-3 by replacing the single tongue 40 with two tongues 140 spaced from one another. It operates in the same fashion and can replace the latch 10 in the sleeve pack 16.

Figure 7:
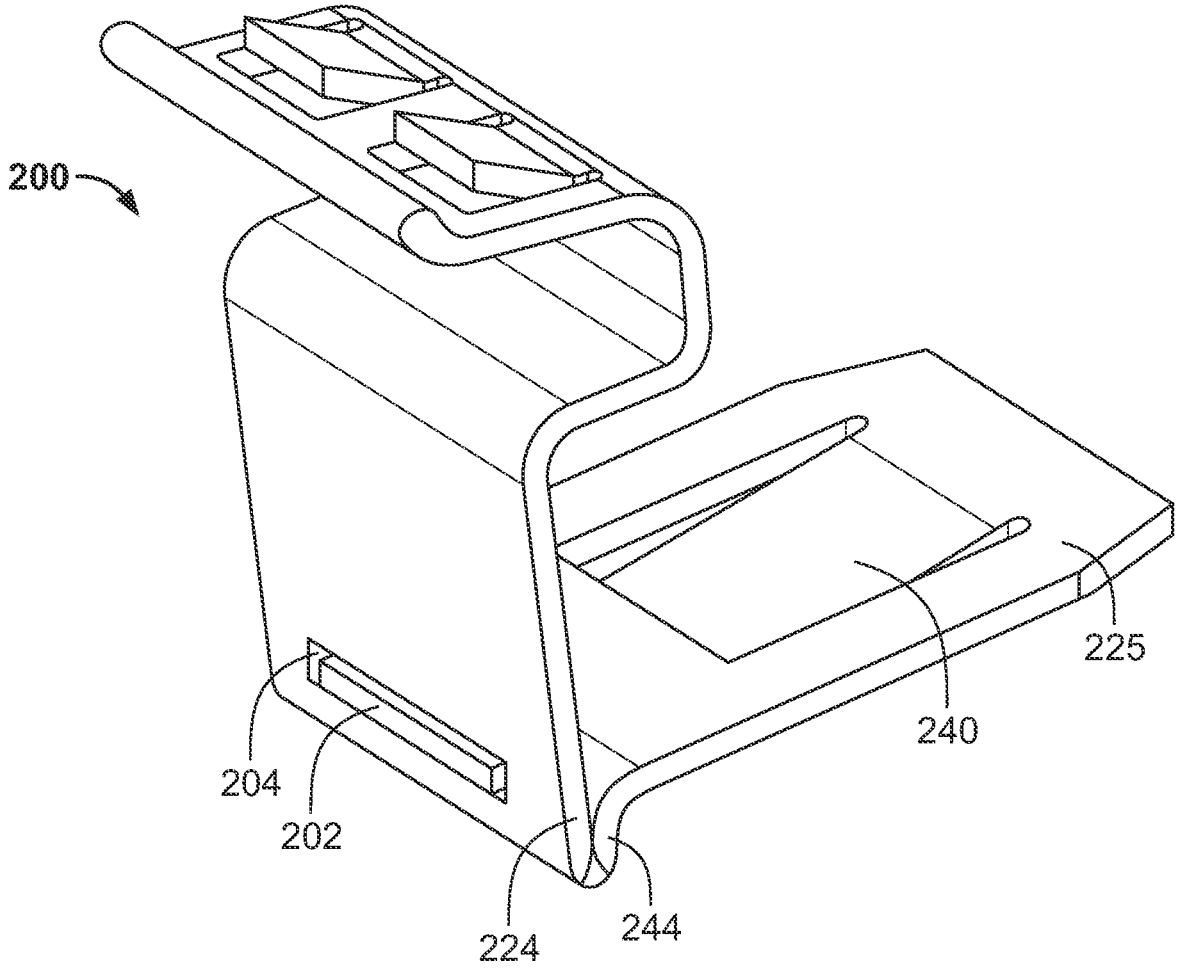
FIG. 7 is a perspective view of an alternate latch.
Figure 8:
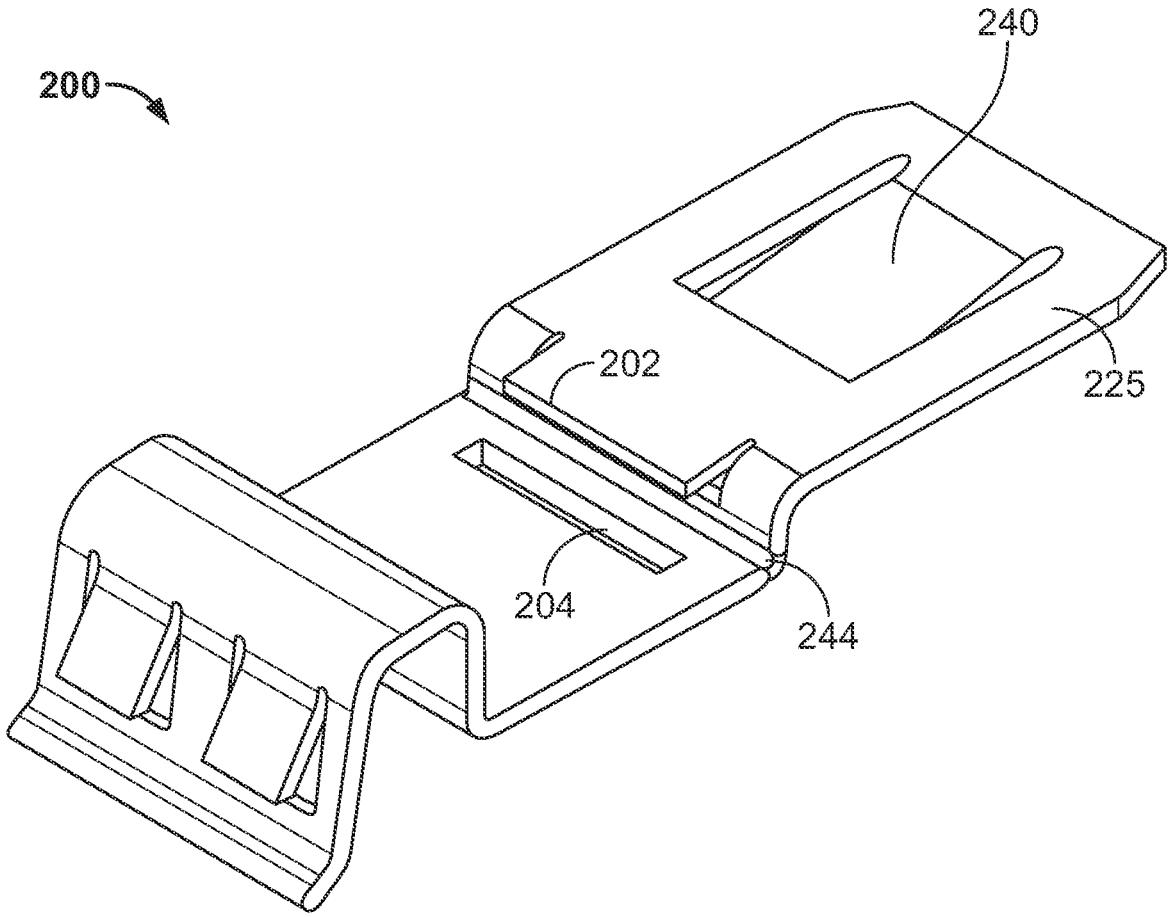
FIG. 8 is a perspective view of the alternative latch of FIG. 6 in a disengaged position.
Figure 9:
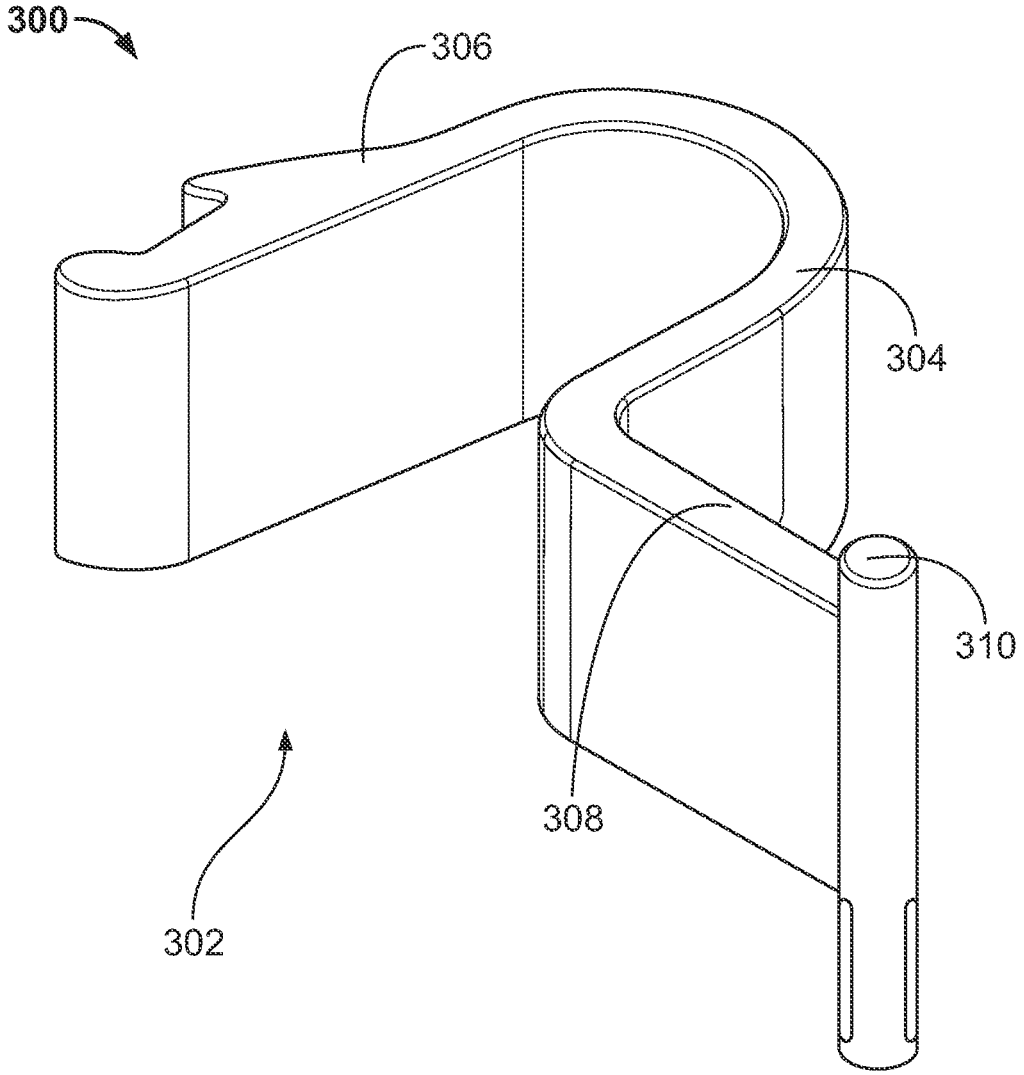
FIG. 9 is a perspective view of an alternate latch.

FIGS. 7 and 8 show another alternate latch 200 that is the same as the latch 10 but further includes a tab 202 on the fifth portion 225 and a slot 204 on the fourth portion 224. The tab 202 is positioned in the slot 204, when the latch is in the engaged position. The tab 202 crosses over the living hinge 244 and traps the living hinge between interfacing surfaces of the fourth portion 224 and the fifth portion 225. This serves to protect the living hinge from repeated uses of the latch.

FIGS. 9-15 show another embodiment of a latch 300. The latch 300 has a U-shaped body 302 with a first leg 304 and a second leg 306. An arm 308 extends from the first leg 304 and terminates in an axle 310. A gusset 312 is provided connecting a portion of the first let and the arm 308 to strengthen the latch 300. The second leg 306 terminates in an enlarged distal end 330 having a lower jaw 331, a C-shaped cutout 332, and a terminal flange 334. The C-shape cutout engages 332 two orthogonal surfaces of an aperture 13 when the latch is in the engaged position. The axle 310 is disposed orthogonally to the arm and extends beyond both lateral edges of the arm. In other words, both opposed ends of the axle extend beyond a respective lateral edge of the arm. It is contemplated the axle could extend beyond only one lateral edge instead of both as shown.

Figure 10:
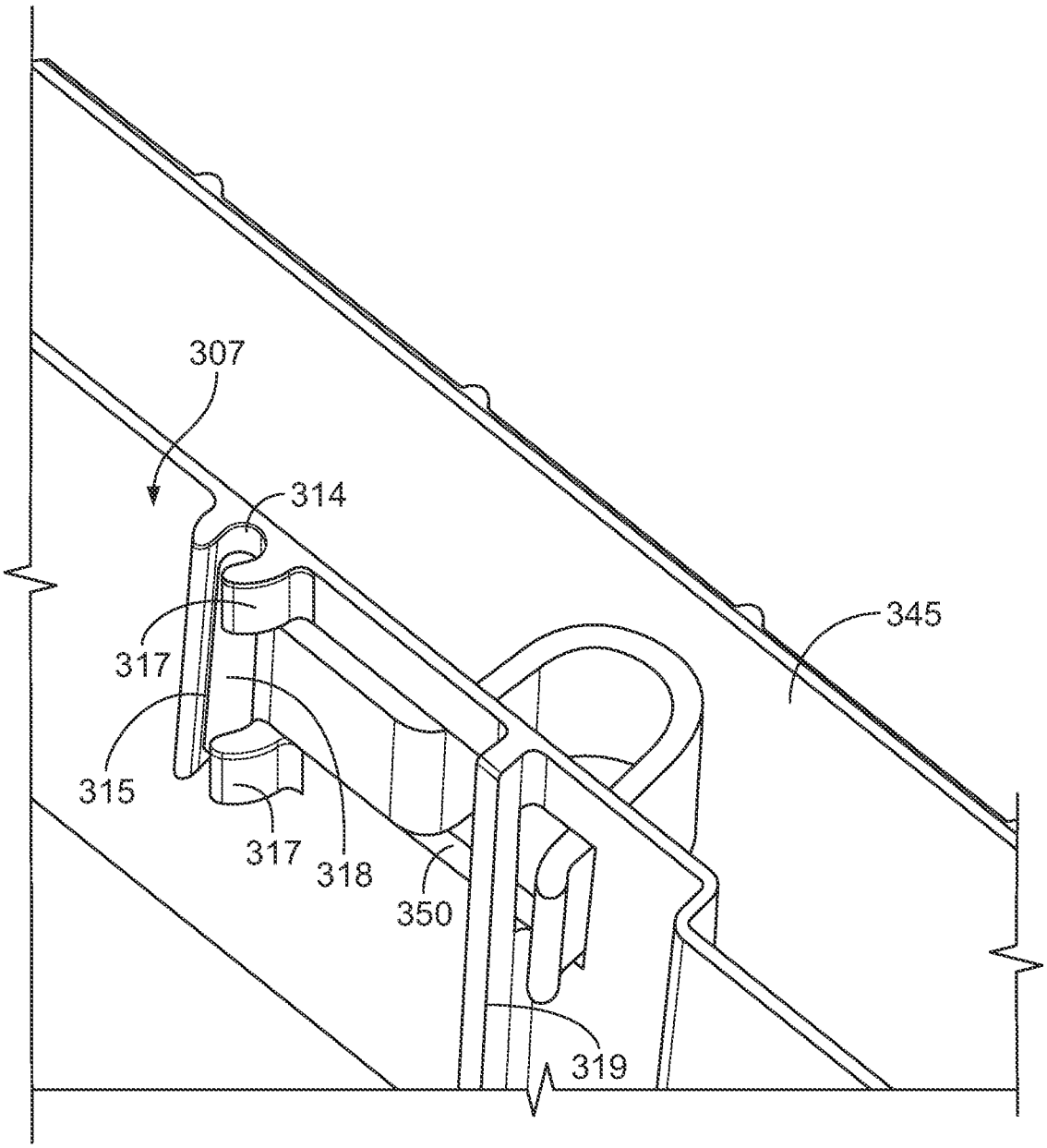
FIG. 10 is a perspective view of an assembly of the alternate latch of FIG. 8 in an engaged position and pivotally mounted to a frame.
Figure 11:
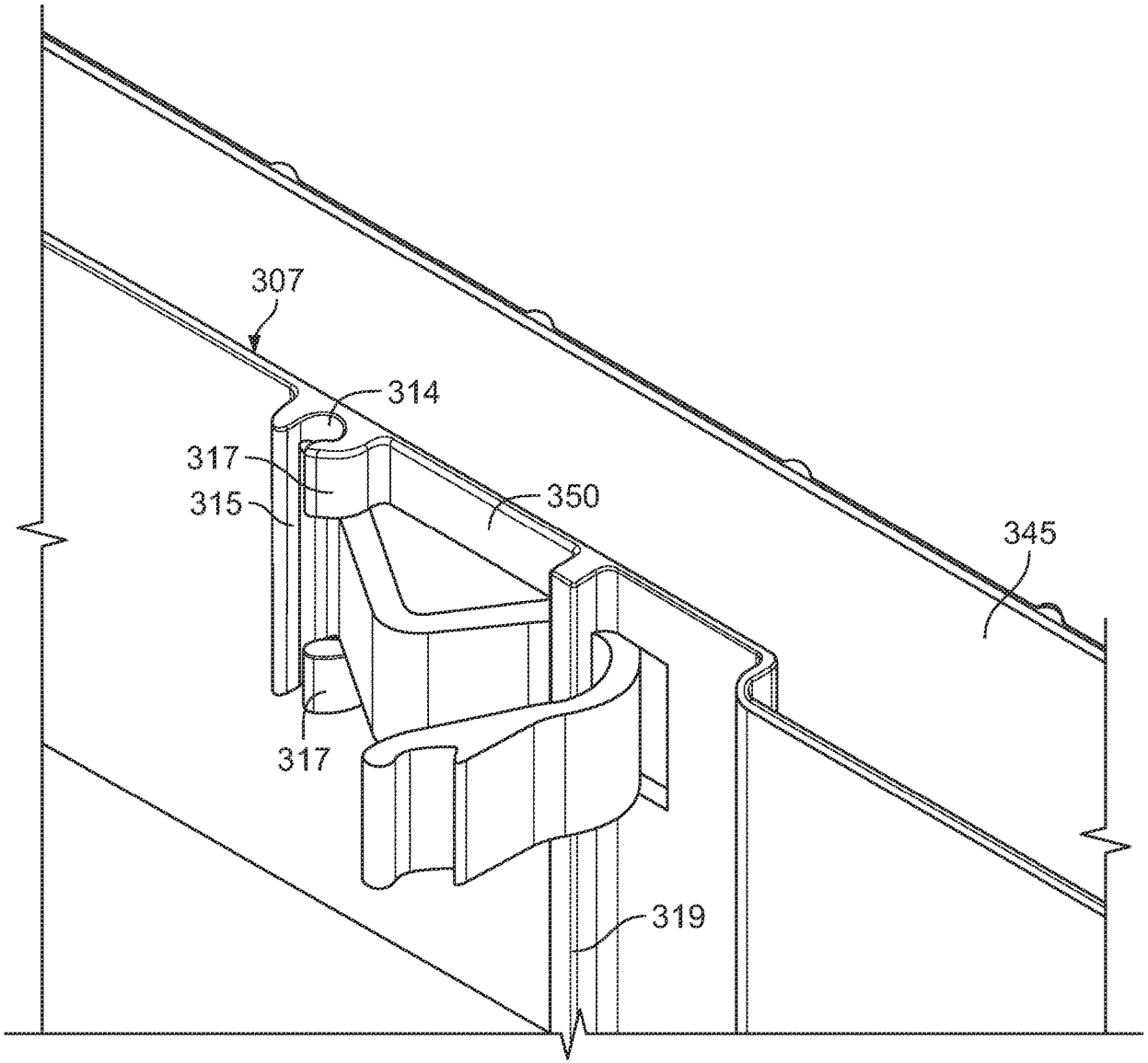
FIG. 11 is a perspective view of an assembly of the alternate latch of FIG. 8 in an disengaged position and pivotally mounted to a frame.
Figure 12:
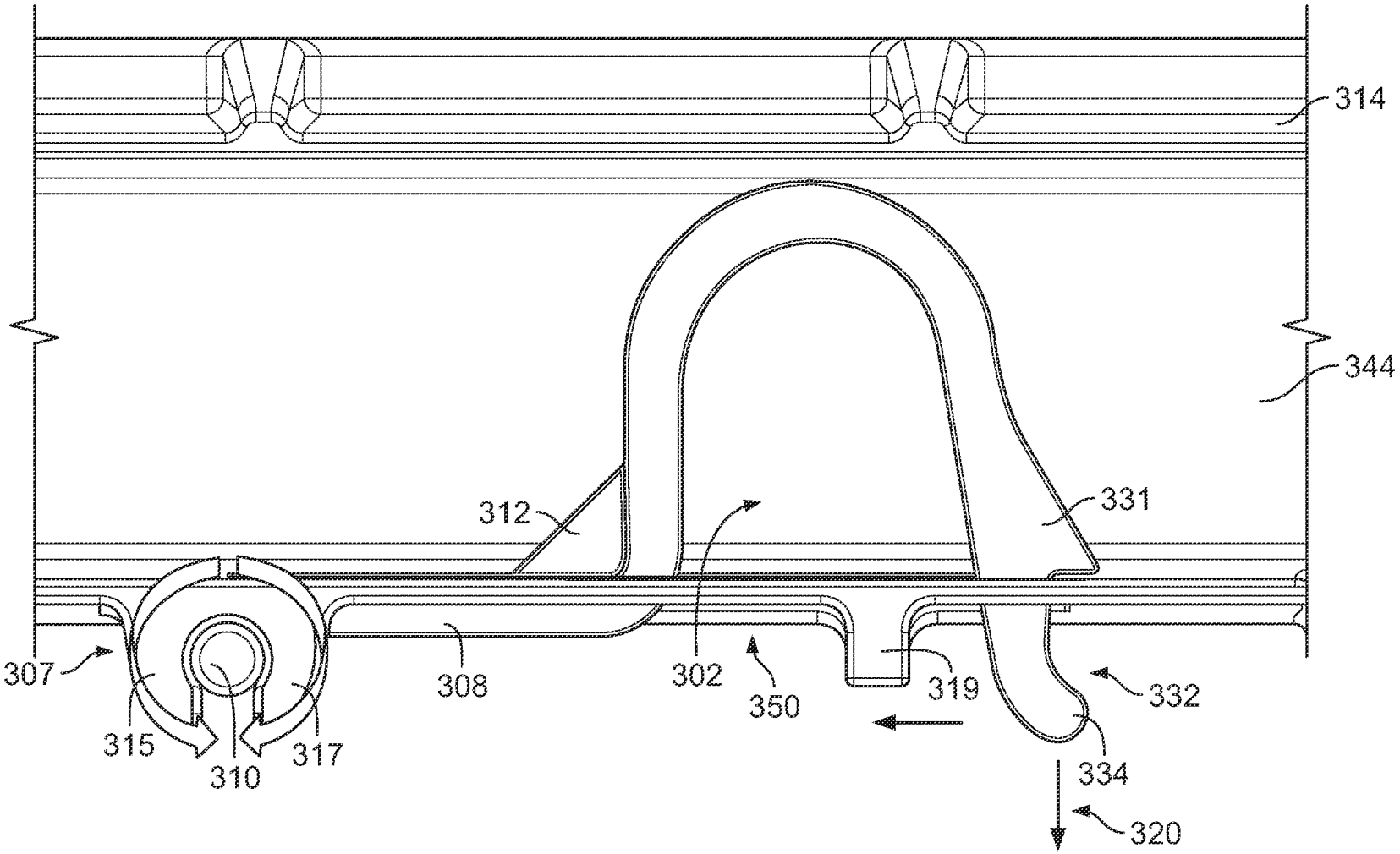
FIG. 12 is a top plan view of the alternate latch of FIG. 8 in an engaged position.
Figure 13:
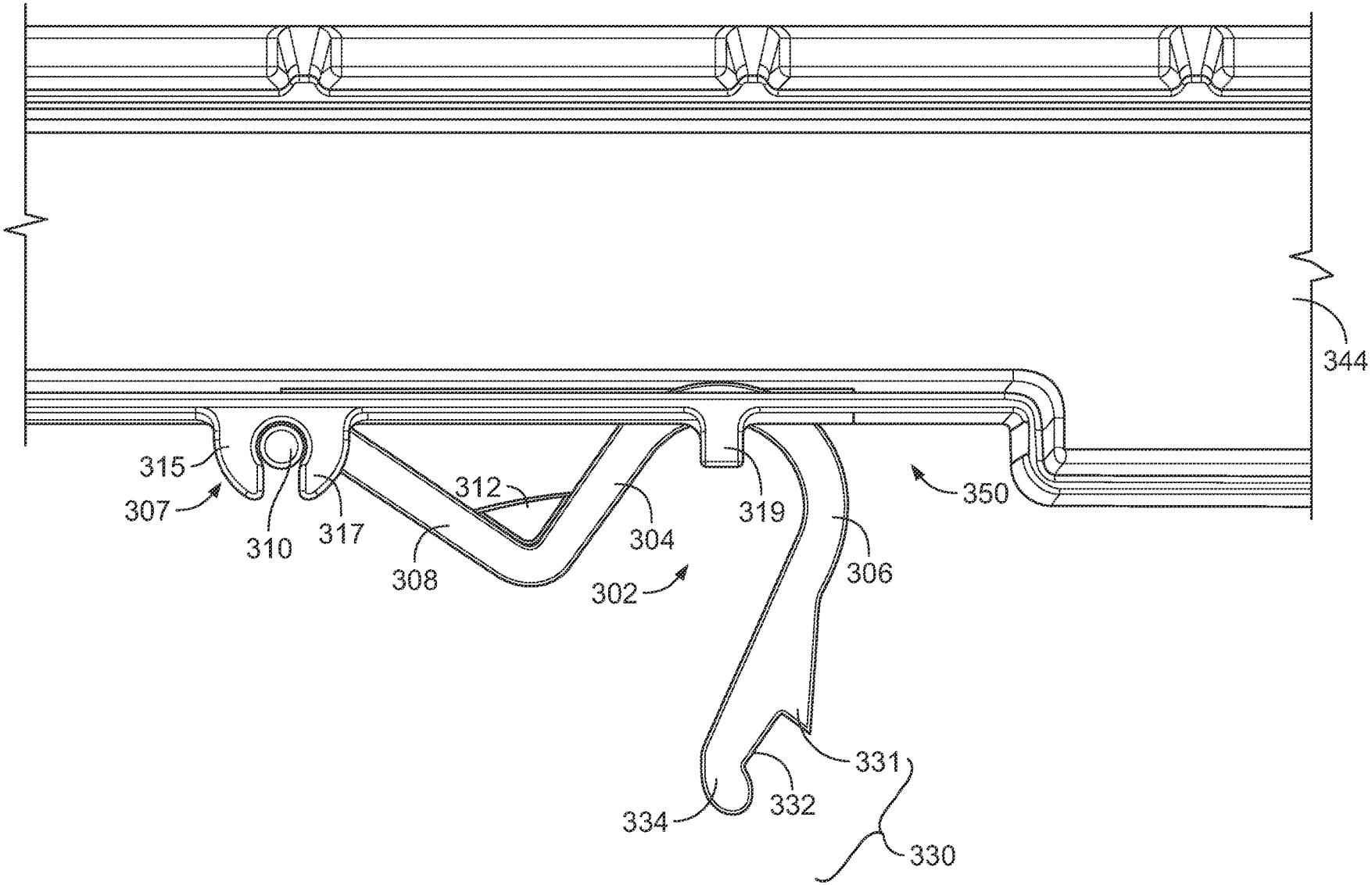
FIG. 13 is a top plan view of the alternate latch of FIG. 8 in a disengaged position.
Figure 14:
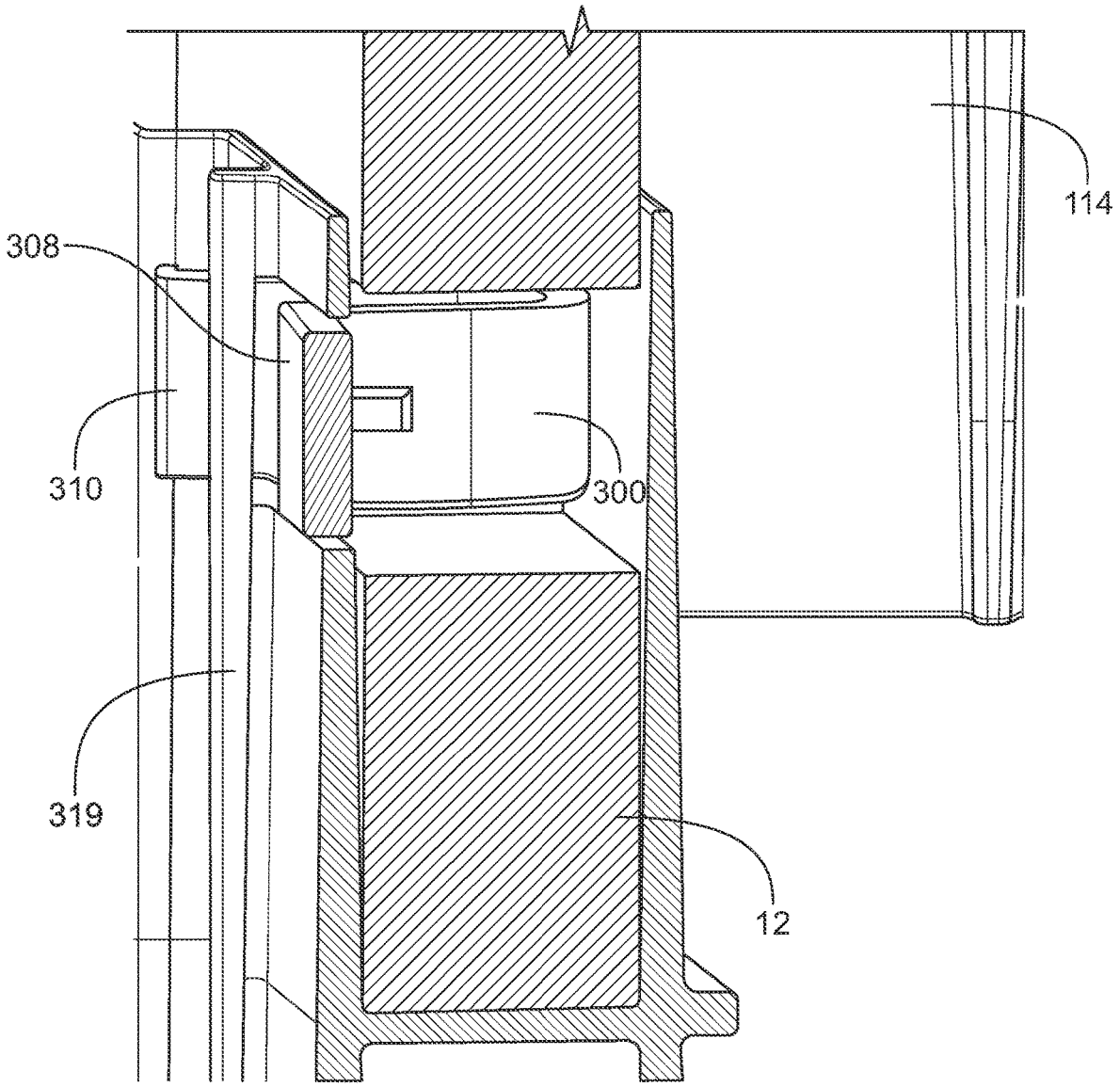
FIG. 14 is a side elevational view in cross section of the alternate latch of FIG. 8 in an engaged position in a sleeve pack.

FIGS. 10 and 11 show the outer vertical surface 345 of the pallet that has an axle mounting structure 307 to receive the axle in a snap-fit arrangement where the axle is free to rotate within the structure 307. The latch 300 can rotate between an engaged position of FIG. 12 to a disengaged position shown in FIG. 13. The mounting structure 307 has a generally C-shaped channel 314 having a back wall 315 and a front wall 316. The back wall is continuous from end to end, but the front wall is segmented with two sub walls 317 separated by a gap 318. The gap 318 provides clearance for the arm 308. A retaining rib 319 extends above an outer planar surface of the vertical surface 345 and vertically from a top portion of the pallet and downward across an opening 350 through the pallet vertical surface 345. The opening 350 is dimensioned to receive a portion of the U-shaped body when the latch is in the engaged position as shown in FIG. 12. The opening 350 provides access for the latch 300 to the channel 344 (FIG. 13). The retaining rib 319 engages the U-shaped member when the latch 300 in the disengaged position as shown in FIGS. 11 and 13. The latch 300 is moved by pressing on the flange 334 inward and downward as indicated by arrows 320. The latch 300 passes through a horizontal plane, perpendicular to the vertical surface, when being moved from the engaged to the disengaged position.

Figure 15:
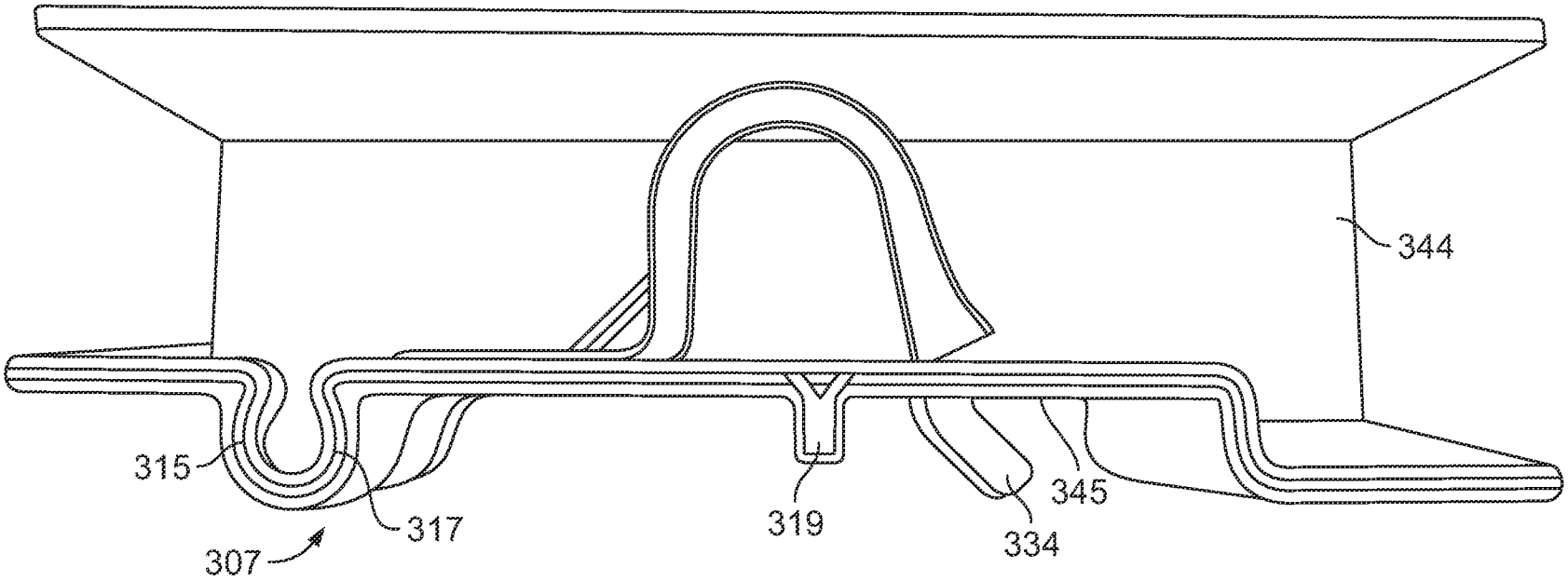
FIG. 15 is a top plan view of an alternative embodiment of the sleeve pack of FIG. 14.

FIG. 15 shows an alternate sleeve pack assembly different from the one shown in FIGS. 9-14. It differs in including the mounting structure 307 facing the opposite direction. That is the opening to the C-shaped channel faces the channel 344 instead of away from the channel.

Many modifications and variations of the present invention are possible in light of the above teachings. It is, therefore, to be understood within the scope of the appended claims the invention may be protected otherwise than as specifically described.

We claim:

1. A sleeve pack assembly comprising:

a plurality of walls connected together to define a polygonal shaped sleeve having an opening at each of two opposed ends, an aperture extends through one of the plurality of walls proximate one of the two opposed ends;

a polygonal shaped frame having a channel for receiving one of the two opposed ends of the sleeve and the aperture; and, a latch having a segmented body with a first portion, a second portion, a third portion, a fourth portion, and a fifth portion, the body having a first generally C-shaped member facing a first direction and a second generally C-shaped member facing a second direction opposed to the first direction wherein a top portion of the second generally C-shaped member is a bottom portion of the first generally C-shaped member, the first portion has a snap extending beyond a planar surface of the first portion and is positioned in the aperture, the fifth portion having a first tongue extending beyond a planar surface of the fifth portion and engaging the polygonal shaped frame;

a flange at a distal end of the first portion, wherein the latch is moveable from an engaged position to a disengaged position by pressing on the flange.

2. The assembly of claim 1 further comprising a living hinge on the fifth portion proximate the fourth portion.

3. The assembly of claim 1 further comprising a second snap on the first portion spaced from the first snap.

4. The assembly of claim 1 wherein the snap is deformed from the first portion and has a proximal end and a distal end, the proximal end is connected to the first portion by a hinge, the snap extends at an angle from three to 45 degrees to the planar surface of the first portion.

5. The assembly of claim 1 wherein the first tongue is deformed from the fifth portion and extends at an angle from three to 45 degrees to the planar surface of the fifth portion.

6. The assembly of claim 5 wherein the tongue is deformed in a first direction and the snap is deformed in a second direction opposed to the first direction.

7. The assembly of claim 1 wherein the aperture is framed by a plurality of connected edges and the first portion engages a first of the plurality of edges and the third portion engages a second of the plurality of edges.

8. The assembly of claim 7 wherein the flange extends outward beyond the sleeve when the latch is in an engaged position.

9. The assembly of claim 1 wherein the fifth portion having a second tongue spaced from the first tongue extending beyond a planar surface of the fifth portion and engaging the polygonal shaped frame.

10. A sleeve pack assembly comprising:

a plurality of walls connected together to define a polygonal shaped sleeve having an opening at each of two opposed ends, an aperture extends through one of the plurality of walls proximate one of the two opposed ends;

a polygonal shaped frame having a channel for receiving one of the two opposed ends of the sleeve and the aperture; and, a latch having a segmented body with a first portion, a second portion, a third portion, a fourth portion, and a fifth portion, the body having a first generally C-shaped member facing a first direction and a second generally C-shaped member facing a second direction opposed to the first direction, the first portion has a snap extending beyond a planar surface of the first portion and is positioned in the aperture, the fifth portion having a first tongue extending beyond a planar surface of the fifth portion and engaging the polygonal shaped frame, a flange at a distal end of the first portion wherein the latch is moveable from an engaged position to a disengaged position by pressing on the flange.

* * * * *